US009711039B2

(12) United States Patent
Shearer

(10) Patent No.: US 9,711,039 B2
(45) Date of Patent: Jul. 18, 2017

(54) INCREASING RADIO FREQUENCY POWER OF ACTIVATION MESSAGES BY ADDING DEAD TIME

(71) Applicant: Gentex Corporation, Zeeland, MI (US)

(72) Inventor: Carl L. Shearer, Hudsonville, MI (US)

(73) Assignee: GENTEX CORPORATION, Zeeland, MI (US)

( * ) Notice: Subject to any disclaimer, the term of this patent is extended or adjusted under 35 U.S.C. 154(b) by 0 days.

(21) Appl. No.: 15/064,864

(22) Filed: Mar. 9, 2016

(65) Prior Publication Data

US 2016/0267782 A1 Sep. 15, 2016

Related U.S. Application Data

(60) Provisional application No. 62/131,059, filed on Mar. 10, 2015.

(51) Int. Cl.
*G08C 17/02* (2006.01)

(52) U.S. Cl.
CPC ..... *G08C 17/02* (2013.01); *G08C 2201/20* (2013.01)

(58) Field of Classification Search
CPC .... G08C 17/02; G08C 2201/20; G08C 19/28; E05F 15/77; E05Y 2400/664; E05Y 2900/106; G07C 2009/00349; G07C 2009/00928; G07C 9/00309; G07C 9/00857; H04B 1/036; H04B 1/3838; H04B 1/202; H04L 1/1854
USPC ..... 340/12.22, 12.23
See application file for complete search history.

(56) References Cited

U.S. PATENT DOCUMENTS 5,699,055 A * 12/1997 Dykema ..... G08C 17/02 340/13.24
6,137,421 A * 10/2000 Dykema ..... G07C 9/00857 340/12.28
6,978,126 B1 * 12/2005 Blaker ..... G07C 9/00309 340/4.3

(Continued)

FOREIGN PATENT DOCUMENTS

WO WO-2014/210491 A2 12/2014

OTHER PUBLICATIONS

International Search Report and Written Opinion of the International Searching Authority in corresponding International Application No. PCT/US2016/021460 dated Jun. 6, 2016, 6 pages.

*Primary Examiner* — Yong Hang Jiang
(74) *Attorney, Agent, or Firm* — Foley & Lardner LLP; Bradley D. Johnson

(57) ABSTRACT

A trainable transceiver for controlling a remote device includes a transceiver circuit, a user input device, and a control circuit. The transceiver circuit is configured to receive a first activation signal from an original transmitter and configured to transmit a second activation signal. The control circuit is coupled to the transceiver circuit and the user input device. The control circuit is configured to format and transmit the second activation signal, based on the first activation signal, in response to a user input received at the user input device. The control circuit is configured to reduce a duty cycle of the second activation signal relative to the first activation signal and increase a radio frequency power of the second activation signal relative to the first activation signal, while maintaining, for the second activation signal, an average radio frequency power over a predetermined amount of time below a predetermined limit.

20 Claims, 4 Drawing Sheets

(56) References Cited

U.S. PATENT DOCUMENTS

| | | | | |
|---|---|---|---|---|
| 2002/0167930 | A1* | 11/2002 | Pearl | H04B 1/036<br>370/345 |
| 2006/0067245 | A1 | 3/2006 | Pearl | |
| 2006/0234670 | A1 | 10/2006 | Blaker et al. | |
| 2009/0189741 | A1* | 7/2009 | Rowland | A61B 5/0031<br>340/10.4 |

* cited by examiner

INCREASING RADIO FREQUENCY POWER OF ACTIVATION MESSAGES BY ADDING DEAD TIME

CROSS-REFERENCE TO RELATED APPLICATIONS

This application claims the benefit of and priority to U.S. Provisional Application No. 62/131,059, filed Mar. 10, 2015, which is incorporated herein by reference in its entirety.

FIELD

The present disclosure relates generally to the field of trainable transceivers for controlling a remote device, and more particularly to a trainable transceiver configured to increase a radio frequency power of a signal transmitted to the remote device.

BACKGROUND

A wireless control system may provide control of remote electronic systems including home automation systems, security gate systems, and garage door openers, lighting systems, appliances, security system, and/or other remote electronic systems. The wireless control system may be trained to control home electronic devices based on an activation signal received from an original transmitter associated with the remote electronic system. It is challenging and difficult to provide trainable wireless control systems which provide for high power when transmitting a variety of learned activation signals, while maintaining compliance with government regulations regarding the power of transmissions (e.g., Federal Communications Commission (FCC) rule 15.231).

SUMMARY

One embodiment of the invention relates to a trainable transceiver for controlling a remote device. The trainable transceiver includes a transceiver circuit, a user input device, and a control circuit. The transceiver circuit is configured to receive a first activation signal from an original transmitter and configured to transmit a second activation signal. The control circuit is coupled to the transceiver circuit and the user input device. The control circuit is configured to format and transmit the second activation signal, based on the first activation signal, in response to a user input received at the user input device. The control circuit is configured to reduce a duty cycle of the second activation signal relative to the first activation signal and increase a radio frequency power of the second activation signal relative to the first activation signal, while maintaining, for the second activation signal, an average radio frequency power over a predetermined amount of time below a predetermined limit.

Another embodiment relates to a method for training a trainable transceiver. The method includes receiving, at a transceiver circuit of the trainable transceiver, a first activation signal from an original transmitter. The method includes formatting, at a control circuit of the trainable transceiver, a second activation signal based on the first activation signal, the second activation signal having a reduced duty cycle relative to the first activation signal, an increased radio frequency power relative to the first activation signal, and an average radio frequency power maintained over a predetermined amount of time below a predetermined limit.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
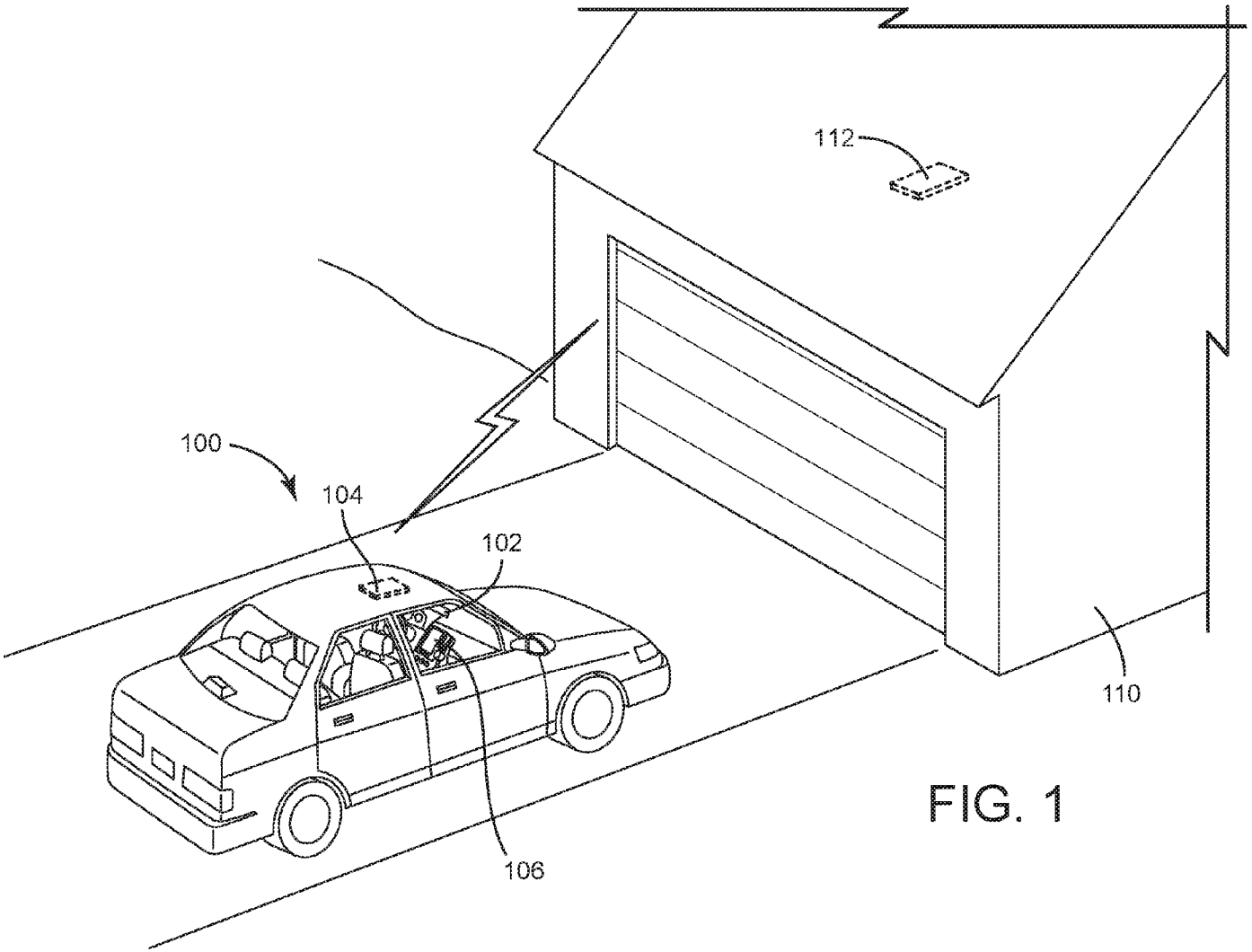
FIG. 1 illustrates a vehicle having a trainable transceiver, according to an exemplary embodiment.

The present invention, according to one embodiment, analyzes activation signals received during the training process to determine the duty cycle of the activation signal transmitted by an original transmitter. The trainable transceiver of the wireless control system determines if the duty cycle of the received activation signal may be reduced and the radio frequency (RF) power increased while maintaining the RF power at or below the maximum allowed transmission power under FCC rule 15.231. For example, if the duty cycle of the received activation signal is high (e.g., high duty cycle modulation scheme and multiple messages repeated within a sliding window for determining allowed maximum power,) the trainable transceiver configures itself for inserted dead time and increased RF power. Advantageously, increasing dead time and RF power allows for the trainable transceiver to use higher transmitting power relative to the original transmitter resulting in an increased transmitting range relative to the original transmitter where possible and comply with government regulations regarding transmission power.

Referring to the FIGURES generally, according to one exemplary embodiment, a vehicle wireless control system includes a trainable RF transceiver configured to generate and transmit RF signals with a dead time to activate a remote system. The generated RF signals may meet government requirements for garage door openers. The trainable transceiver unit may be configured to "learn" the characteristics of multiple activation signals generated by multiple original transmitter (e.g., an original transmitter for a garage door, a security gate, a home lighting system, a home security system, etc.) and store one or more characteristics of the activation signal in a local memory for use in subsequent transmissions of activation signals formatted to control the remote electronic systems associated with the original transmitter. The trainable transceiver unit may reproduce a modified activation signal upon receiving a user input (e.g. via a push button, a voice command, etc.) and may transmit the activation signal formatted to control the remote electronic system (e.g., formatted to cause a garage door open to change state upon receipt).

In some embodiments, the trainable transceiver adds dead time within the transmission time frame and increases the transmission power based on the calculated available dead time which may be added and/or the calculated available power increase which may be achieved while maintaining compliance with government regulations or otherwise remaining below threshold values (e.g., maximum average RF power over the transmission time frame).

The trainable transceiver unit may be integrated within a vehicle system component such as a rear view mirror, an instrument panel, a headliner, or other locations within the vehicle. Advantageously, the trainable transceiver unit may be installed quickly and easily into an existing vehicle (e.g. as part of a vehicle upgrade or retrofit) without requiring extensive integration with the existing vehicle system. For example, the trainable transceiver unit may be a standalone device capable of independent and self-sufficient operation without relying on input from a vehicle subsystem or energy from the main vehicle battery. The trainable transceiver unit may include all the necessary processing electronics for learning, storing, and retransmitting a control signal. The trainable transceiver unit may further include a battery (e.g., separate from the main vehicle battery) used to power only the trainable transceiver unit.

In some embodiments, the trainable transceiver unit is integrated with a rear view mirror assembly for the vehicle. For example, the trainable transceiver unit may include a battery and a transceiver circuit mounted between a front reflective surface (e.g., the mirror) and a back housing of the rear view mirror assembly. The trainable transceiver unit may include one or more user input devices for controlling collection and retransmission for a remote control signal.

In some embodiments, a constant dead time may be added based on the type of activation signal received without analyzing the duty cycle of the received activation signal. For example, the trainable transceiver may determine that an activation signal corresponds with a particular type, make, and/or model of a remote electronic system for which a known duty cycle is known. The trainable transceiver, based on this determination, adds a fixed amount of dead time based on either an amount of dead time stored in memory for the identified remote electronic system or a stored known duty cycle stored in memory for the identified remote electronic system.

Referring to FIG. 1, a perspective view of a vehicle 100 and garage 110 is shown, according to an exemplary embodiment. Vehicle 100 may be an automobile, truck, sport vehicle, or other vehicle. Vehicle 100 is shown to include a trainable transceiver unit 102. In some embodiments, trainable transceiver unit 102 may be integrated with a mirror assembly (e.g., a rear view mirror assembly) of vehicle 100. In other embodiments, trainable transceiver unit 102 may be mounted to other vehicle interior elements, such as a vehicle headliner 104, a center stack 106, a visor, an instrument panel, or other control unit within vehicle 100.

Trainable transceiver unit 102 is configured to communicate with a remote electronic system 112 of a garage 110 or other structure. In some embodiments, remote electronic system 112 is configured to control operation of a garage door attached to garage 110. In other embodiments, remote electronic system 112 may be a home lighting system, a home security system, a data network (e.g., using ASK, using OOK, using FSK, LAN, WAN, cellular, etc.), a HVAC system, or any other remote electronic system capable of receiving control signals from trainable transceiver unit 102.

Trainable transceiver unit 102 is configured to reduce a duty cycle of a received activation signal relative and increase radio frequency power of subsequent transmissions of activation signals based on the received activation signal, while maintaining, an average radio frequency power over a predetermined amount of time below a predetermined limit. This provides an advantage in that trainable transceiver unit 102 has a greater range allowing for users in vehicle 100 to control remote electronic systems 112 (e.g., a garage door opener) from a greater distance.

Figure 2:
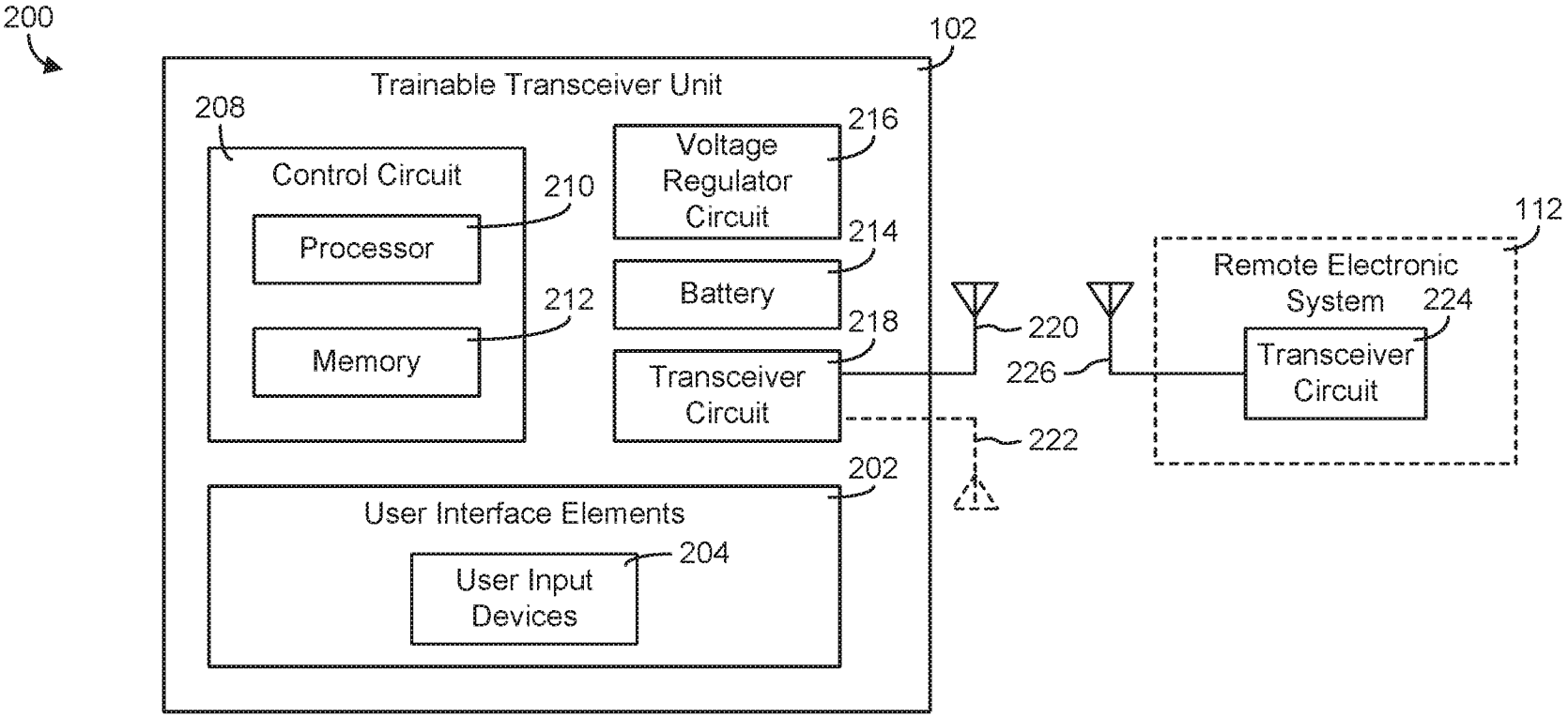
FIG. 2 illustrates a block diagram of a trainable transceiver and a remote electronic system, according to an exemplary embodiment.

Referring now to FIG. 2, a block diagram of a system 200 including a trainable transceiver unit 102 and a remote electronic system 112 is shown, according to an exemplary embodiment. In brief overview, trainable transceiver unit 102 is shown to include user interface elements 202, a control circuit 208, a battery 214, a voltage regulator circuit 216, and a transceiver circuit 218.

User interface elements 202 may facilitate communication between a user (e.g., driver, passenger, or other occupant of vehicle 100) and trainable transceiver unit 102. For example, user interface elements 202 may be used to receive input from a user. User interface elements 202 are shown to include user input devices 204.

In some embodiments, user input devices 204 include one or more push buttons, switches, dials, knobs, touch-sensitive user input devices (e.g., piezoelectric sensors, capacitive touch sensors, etc.), or other devices for translating a tactile input into an electronic data signal. Advantageously, user input devices 204 may be integrated with a rear view mirror assembly of vehicle 100. For example, user input devices 204 may include one or more pushbuttons (e.g., mounted along a bottom surface of a rear view mirror assembly). User input devices 204 may provide input signals to control circuit 208 for controlling operation of trainable transceiver unit 102. It should be noted that user interface devices may include devices not closely integrated with the trainable transceiver, such as a touchscreen device included in a center stack of a vehicle 100, voice input engine, etc.

Still referring to FIG. 2, trainable transceiver unit 102 is shown to include a control circuit 208. Control circuit 208 may be configured to receive input from user input devices 204. Control circuit 208 may further be configured to operate transceiver circuit 218 for conducting electronic data communications with remote electronic system 112. Control circuit 208 is configured to perform the functions of trainable transceiver unit 102 as described herein.

Control circuit 208 is shown to include a processor 210 and memory 212. Processor 210 may be implemented as a general purpose processor, a microprocessor, a microcontroller, an application specific integrated circuit (ASIC), one or more field programmable gate arrays (FPGAs), a CPU, a GPU, a group of processing components, or other suitable electronic processing components.

Memory 212 may include one or more devices (e.g., RAM, ROM, Flash® memory, hard disk storage, etc.) for storing data and/or computer code for completing and/or facilitating the various processes, layers, and modules described in the present disclosure. Memory 212 may include volatile memory or non-volatile memory. Memory 212 may include database components, object code components, script components, or any other type of information structure for supporting the various activities and information structures described in the present disclosure. In some implementations, memory 212 is communicably connected to processor 210 via control circuit 208 and includes computer code (e.g., data modules stored in memory 212) for executing one or more control processes described herein.

Still referring to FIG. 2, trainable transceiver unit 102 is shown to include a transceiver circuit 218 and an antenna 220. Transceiver circuit 218 may include transmitting and/or receiving circuitry configured to communicate via antenna 220 with remote electronic system 112. Transceiver circuit 218 may be configured to transmit wireless control signals having control data for controlling remote electronic system 112. Transceiver circuit 218 may be further configured to receive wireless status signals including status information from remote electronic system 112. Trainable transceiver unit 102 and remote electronic system 112 may communicate using any suitable wireless standard (e.g., using ASK, using OOK, using FSK, LAN, WAN, cellular, etc.) or other communications protocols compatible with or proprietary to remote electronic system 112. Trainable transceiver unit 102 may be configured to learn and replicate control signals using any wireless communications protocol.

In a training mode of operation, transceiver circuit 218 may be configured to receive one or more characteristics of an activation signal sent from an original transmitter for use with remote electronic system 112. An original transmitter may be a remote or hand-held transmitter, which may be sold with remote electronic system 112 or as an after-market item. The original transmitter may be configured to transmit an activation signal at a predetermined carrier frequency and having control data configured to actuate remote electronic system 112. For example, the original transmitter may be a hand-held garage door opener transmitter configured to transmit a garage door opener signal at a frequency (e.g., centered around 315 MHz or 355 MHz, etc.). The activation signal may include control data, which can be a fixed code, a rolling code, or another cryptographically-encoded code. Remote electronic system 112 may be configured to open a garage door, for example, in response to receiving the activation signal from the original transmitter.

Transceiver circuit 218 may be configured to identify and store one or more characteristics of the activation signal (e.g., signal frequency, control data, modulation scheme, etc.) from the original transmitter or from another source. In some embodiments, transceiver circuit 218 is configured to learn at least one characteristic of the activation signal by receiving the activation signal, determining the frequency of the activation signal, and/or demodulating the control data from the activation signal. Additionally, trainable transceiver unit 102 can receive one or more characteristics of the activation signal by other methods of learning. For example, the one or more characteristics of the activation signal can be preprogrammed into memory 212 during manufacture of trainable transceiver unit 102, input via user input devices 204, or learned via a "guess and test" method. These additional sources of activation signal characteristics may be used to supplement the characteristics of the activation signal learned from receiving the activation signal from the original transmitter. Trainable transceiver unit 102 may store the characteristics of the activation signal in memory 212.

Transceiver circuit 218 may be configured to generate a carrier frequency at any of a number of frequencies (e.g., in response to a control signal from control circuit 208). In some embodiments, the frequencies generated can be in the ultra-high frequency range (e.g., between 20 and 470 megahertz (MHz), between about 20 and 950 MHz, between about 280 and 434 MHz, up to 868 MHz, up to 920 MHz, up to 960 MHz, etc.) or in other frequency ranges. The control data modulated with the carrier frequency signal may be frequency shift key (FSK) modulated, amplitude shift key (ASK) modulated, or modulated using another modulation technique. Transceiver circuit 218 may be configured to generate an activation signal having fixed code, a rolling code, or other cryptographically encoded control code suitable for use with remote electronic system 112. Trainable transceiver unit 102 uses characteristics of an activation signal stored in memory as part of the training process to format activation signals for controlling remote electronic system 112, and the activation signals are transmitted using transceiver circuit 218.

Transceiver circuit 218 may use antenna 220 to increase a range or signal quality of the communications between trainable transceiver unit 102 and remote electronic system 112. In some embodiments, antenna 220 is a monopole antenna including a single antenna branch. In other embodiments, a second antenna branch 222 may be used. Antenna branch 222 and antenna 220 may be arranged in a dipole configuration (e.g., extending in opposite directions from an antenna stem, as a dipole loop, etc.). The dipole configuration may improve system performance by preventing resonance at an undesirable frequency.

In some embodiments, trainable transceiver unit 102 includes an activation signal analysis module. The activation signal analysis module is stored in memory 212 and includes programs, instructions, functions, or other information which when executed by processor 210 determines the duty cycle of a received activation signal. This allows trainable transceiver unit 102 to determine if transmission power may be increased if the existing duty cycle is modified to increase dead time or if the duty cycle of the received activation signal should not be modified with the inclusion of dead time to allow for increased RF power when transmitting activation signals. For example, the duty cycle may not need to be modified to include additional dead time (e.g., higher power) in an instance such as a case in which the default duty cycle is sufficient to meet power targets without increasing dead time in a sliding window for average power determination.

The default determination and configuration of trainable transceiver unit 102 may be to repeat a message frequently within the sliding window and have a high duty cycle. Including additional dead time in transmitted activation signals moves away from this default. The default is altered in cases in which the duty cycle of the activation signal is high such that dead time is added or increased to achieve high power while ensuring compliance with government regulations. For example, the trainable transceiver unit may be configured to determine that the first activation signal includes two instances of a repeated message within a sliding window, and format the second activation signal by replacing one instance of the repeated message with dead time and increasing the radio frequency power used to transmit the other instance of the repeated message in the second activation signal.

In some embodiments, trainable transceiver unit 102 includes a decision module. The decision module is stored in memory 212 and includes programs, instructions, functions, or other information which when executed by processor 210 determine whether additional dead time should be added to the activation signal with an increase in RF power or if the existing duty cycle and repetition of transmitted messages should be used. The duty cycle of the received activation signal may already be sufficiently low to allow for transmission of activation signals using this duty cycle and associated RF power. In some embodiments, a threshold value of the duty cycle is used to make this determination. For example, if the duty cycle of the received activation signal is greater than 30% dead time may be added and RF power increased. If the duty cycle is less than 30%, the duty cycle of the received activation signal is used along with the corresponding RF power which complies with government regulations (e.g., is below a maximum average value for a predetermined amount of time). The decision module may further include programs, instructions, functions, or other information for calculating the dead time and RF power values to be used in transmitting activation signals for remote electronic system 112 when it is determined that the duty cycle of the received activation signal can be reduced and the RF power increased while complying with government regulations. In some embodiments, the decision module is configured to calculate the lowest duty cycle necessary to achieve a threshold increase RF power. In some embodiments, the decision module is configured to calculate a duty cycle necessary to maximize the RF power.

Still referring to FIG. 2, system 200 is shown to include a remote electronic system 112. Remote electronic system 112 may be any of a plurality of remote electronic systems, such as a garage door opener (as shown in FIG. 1), security gate control system, security lights, remote lighting fixtures or appliances, a home security system, or another set of remote devices. Remote electronic system 112 is shown to include a transceiver circuit 224 and an antenna 226. Transceiver circuit 224 includes transmit and/or receive circuitry configured to communicate via antenna 226 with trainable transceiver unit 102. Transceiver circuit 224 may be configured to receive wireless control signals from trainable transceiver unit 102. The wireless control signals may include control data for controlling operation of remote electronic system 112.

In some embodiments, trainable transceiver unit 102 determines the amount of dead time to include in an activation signal and/or the RF power of the activation signal using a look up table of values corresponding to a characteristic (e.g., the type, make, manufacturer, and/or model) of remote electronic system 112 associated with an activation signal received from an original transmitter. In further embodiments, the trainable transceiver uses dead time values and/or RF power values, in formatting transmitted activation signals, which are received from a remote source. For example, the values may be wirelessly received from a portable computing device (e.g., a smartphone, tablet, laptop computer, or other portable device), an internet connected device in communication with the trainable transceiver (e.g., an internet connected vehicle), or a server (e.g., providing values according to instructions received from a user at a website or other interface). The values may be selectively provided, requested, or received based on a make or model of remote electronic system 112 associated with a received activation signal; a make or model of remote electronic system 112 provided by a user of the portable computing device, internet connected device, or website; and/or based on other information.

Figure 3:
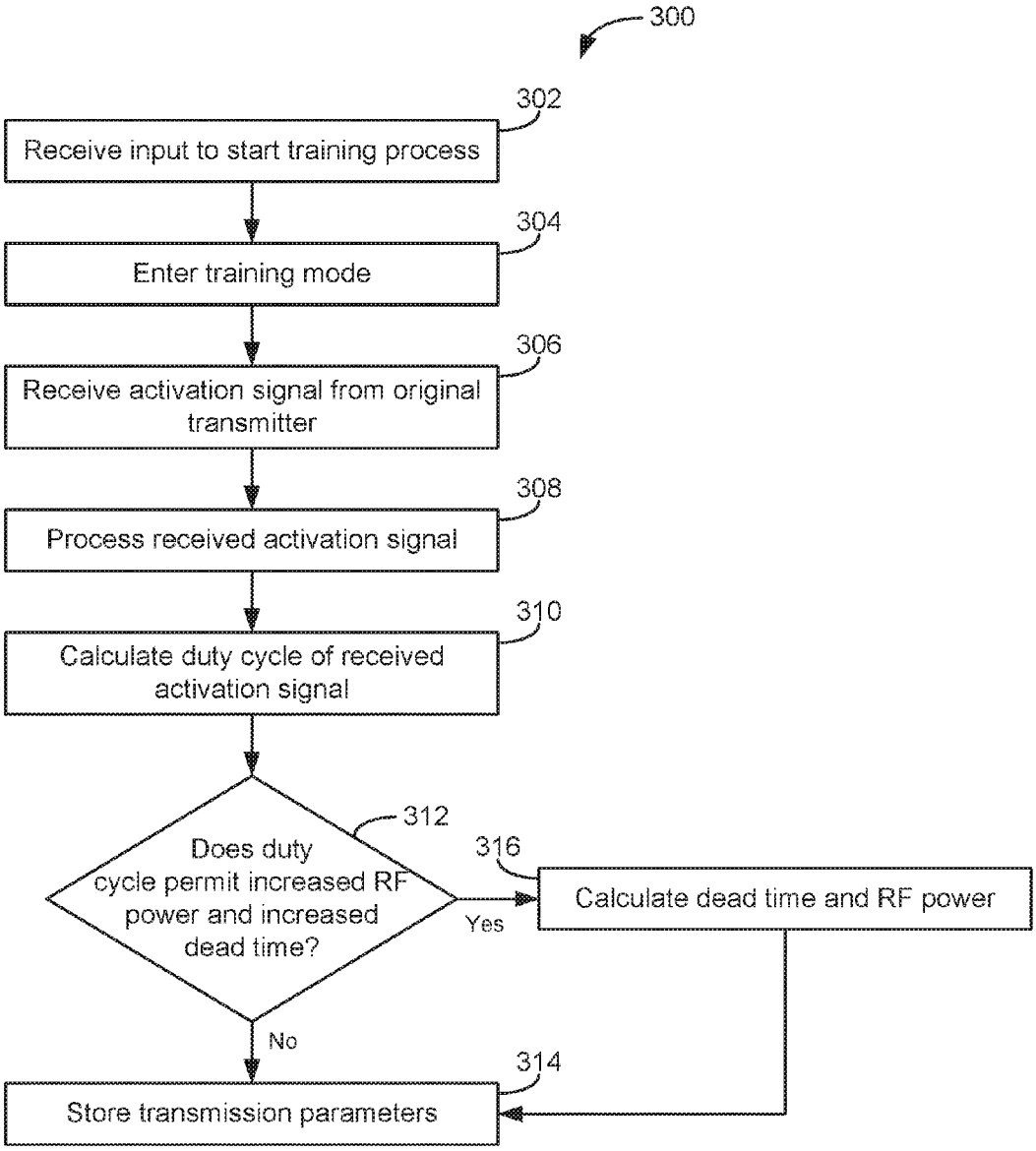
FIG. 3 illustrates a flow chart of a method of a training process for a trainable transceiver, according to an exemplary embodiment.
Figure 4:
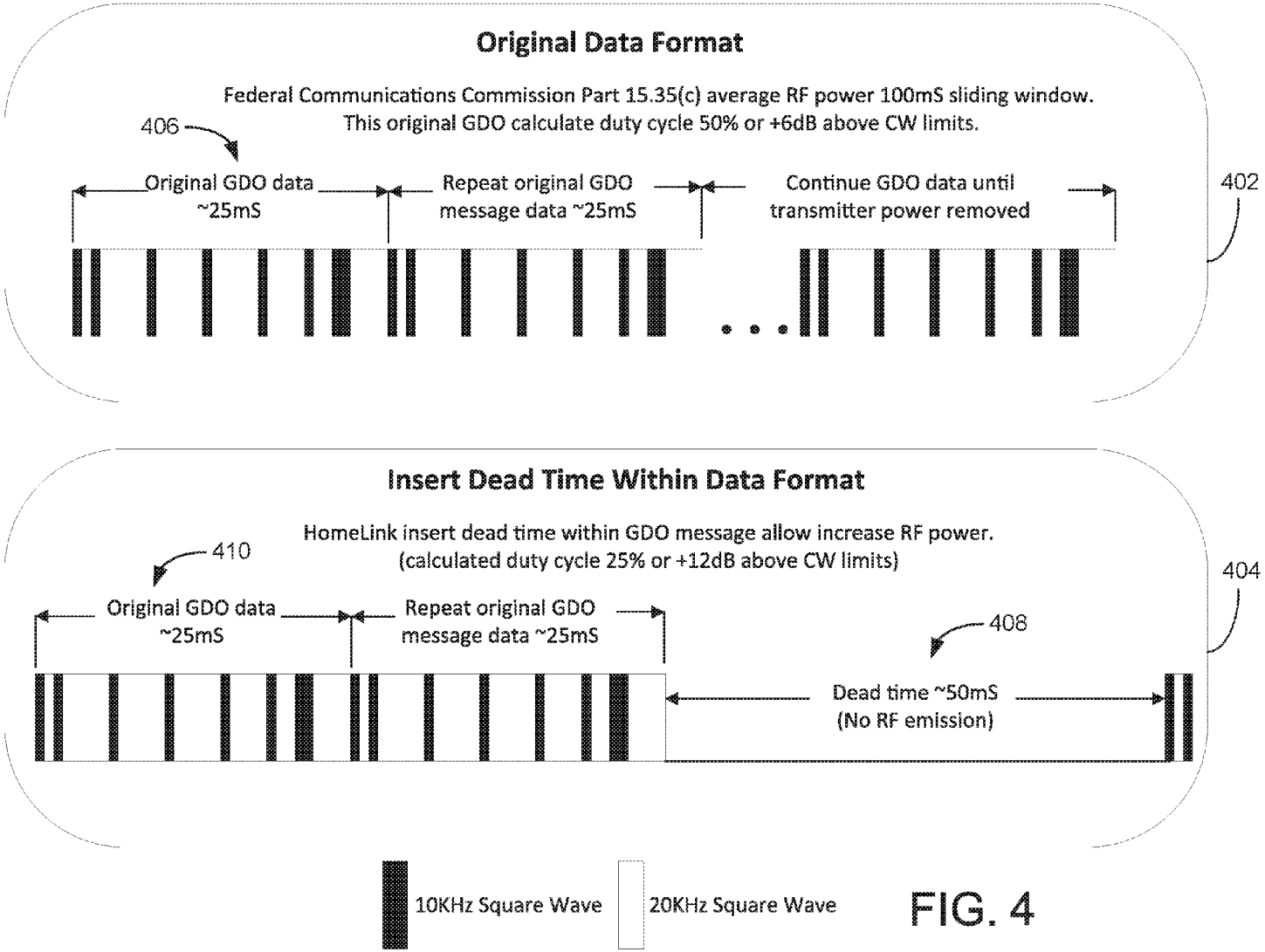
FIG. 4 illustrates a schematic diagram for insertion of dead time into a radio frequency transmission, according to an exemplary embodiment.

Referring now to FIGS. 3 and 4, trainable transceiver unit 102 analyzes an activation signal received from an original transmitter, during a training mode, and may add dead time and increase the transmission power for subsequently transmitting activation signals while in an operational mode. Trainable transceiver unit 102 may be configured to increase power over of a period of time, while staying below certain average power thresholds, by controllably inserting dead time while transmitting activation signals based on the analyses.

Trainable transceiver unit 102 is configured to receive an activation signal from an original transmitter as part of a training process to control the remote electronic system 112 associated with the original transmitter. Trainable transceiver unit 102 stores at least one characteristic of the activation signal in memory for use in formatting an activation signal for controlling the remote electronic system 112. Trainable transceiver unit 102 also analyzes the received activation signal, e.g., using control circuit 208, to determine the amount of modulation present in the signal (e.g., the amount of dead time in the signal between message portions). In some embodiments, trainable transceiver unit 102 analyzes the received activation signal to determine the power of the signal, the modulation of the signal, the amount of dead time in the signal, and/or other parameters of the signal over a set time frame (e.g., one period in which the signal is active or the time it takes the signal to complete an on-off cycle). Trainable transceiver unit 102 calculates and determines the amount of additional dead time which can be added within the time frame (e.g., 100 mS) and an amount of power increase which may be applied to the transmission within the time frame while maintaining the duty cycle, maximum power, average power over the time frame, and/or other signal parameters below a threshold value (e.g., those mandated by the government). For example, the duty cycle may be reduced through the use of additional dead time and RF power increased relative to the activation signal received from the original transmitter. In some embodiments, dead time is added to increase RF power within a 100 mS sliding window time frame. For example, the received activation signal may include a received signal data period during which data is transmitted, and a received signal dead period during which data is not transmitted. Dead time may be added so that within a 100 mS sliding window time frame of the transmitted activation signal, the received signal data period is reproduced while dead time is used in the remainder of the 100 mS sliding window time frame. As one example, a received activation signal may include a received signal data period (e.g., 20 mS, 40 mS, 60 mS, 80 mS, etc.) such that the transmitted activation signal includes a corresponding data period (e.g., 20 mS, 40 mS, 60 mS, 80 mS, etc.) and a corresponding dead time (e.g., a dead time of the remainder of the sliding window time frame, e.g. 80 mS, 60 mS, 40 mS, 20 mS, etc.).

In alternative embodiments, trainable transceiver unit 102 analyzes the received activation signal to determine the type, make, and/or model of the remote electronic system 112 associated with the original transmitter. Trainable transceiver unit 102 then uses a look up table to determine the amount of dead time and RF power to use when transmitting activation signals such that the duty cycle, maximum power, average power over the time frame, and/or other signal parameters are maintained below a threshold value (e.g., those mandated by the government). For example, the duty cycle may be reduced through the use of additional dead time and RF power increased relative to the activation signal received from the original transmitter. For example, during a training process for training the trainable transceiver unit 102 to the remote electronic device 102, the trainable transceiver unit 102 may process an activation signal received from the original transmitted to detect a characteristic (e.g., type, make, model, manufacturer, etc.) of the remote electronic system 112, and determine amounts of dead and RF power to be used for generating an activation signal based on the detected characteristic.

In some embodiments, the trainable transceiver unit 102 is configured to iteratively add dead time and increase RF power of the transmitted activation signal based receiving an acknowledgement signal from the remote electronic system 112. For example, the trainable transceiver unit 102 may be configured to successively transmit activation signals (the activation signal including instructions configured to cause the remote electronic system 112 to transmit an acknowledgement signal) with increasing dead time and/or RF power until an acknowledgement signal is received from the remote electronic system 112. The activation signals may be transmitted from a first location, such as a location from which a user may typically expect to transmit activation signals by the trainable transceiver unit 102 to the remote electronic system 112. In some embodiments, the trainable transceiver unit 102 is configured to store dead times and/or RF powers associated with signals to be transmitted from certain locations in memory 212. In some embodiments, the trainable transceiver unit 102 includes or is configured to communicate with a position/orientation sensor (e.g., GPS sensor, accelerometer, etc.), and receives location information from the position/orientation sensor to be stored in memory 212 along with the dead time and/or RF power information associated with the location.

Referring now to the steps of FIG. 3, a training process 300 flowchart of the RF control system is shown, according to an exemplary embodiment. At step 302, trainable transceiver unit 102 receives an input to start a training process entering training mode 304. For example, a user may start the training process by providing an input such as holding down a button. The user may select one a plurality of buttons for which to train the trainable transceiver unit 102 to control one of a plurality of remote electronic systems 112 (e.g., each button corresponding to an available channel for controlling a particular remote electronic system 112).

In training mode 304, trainable transceiver unit 102 is configured to receive activation signals from an original transmitter using transceiver circuit 218. This is a switch of transceiver circuit 218 operating as a transmitter in a normal operation mode to transceiver circuit 218 operating as a receiver in training mode.

At step 306, trainable transceiver unit 102 receives an activation signal (e.g., using transceiver circuit 218) while in training mode. For example, a user may be instructed to activate an original transmitter corresponding to the remote electronic system 112 for which the trainable transceiver unit 102 is being trained at this time. The activation signal is transmitted from the original transmitter and is received at the trainable transceiver unit 102. The received activation signal may be stored in memory 212 of trainable transceiver unit 102.

At step 308, trainable transceiver unit 102 processes the received activation signal. For example, trainable transceiver unit 102 may use control circuit 208 to identify at least one characteristic of the received activation signal such as frequency, serial number of the remote electronic system 112, encryption key, counter value, original transmitter identifier, transmit count value, etc. The trainable transceiver unit 102 stores the one or more characteristics in memory 212 for later use in formatting activation signals to control remote electronic system 112 during normal operation mode.

At step 310, trainable transceiver unit 102 calculates the duty cycle of the activation signal received from the original transmitter. For example, control circuit 208 may analyze the received activation signal to calculate the amount of dead time present in the received signal (e.g., the duty cycle of the received signal). These calculations may be over a set time period (e.g., 100 mS). At step 312, the trainable transceiver unit 102 determines if the calculated duty cycle of the received activation signal should be used in later transmissions of activation signals or if the amount of dead time and RF power should be increased, relative to the received activation signal, in transmitting activation signals using the stored activation signal characteristics, while maintaining the RF transmission power within a maximum average RF power limits for a predetermined amount of time (e.g., those limits set by the government). In some cases, the trainable transceiver unit 102 uses a threshold value to determine whether to modify the duty cycle and RF power. For example, if the received activation signal has a duty cycle of greater than 25%, the duty cycle may be modified by adding dead time and the RF power of subsequent activation signal transmissions is increased (while staying below maximum values set by government regulations). If the received activation signal has a duty cycle at or below 25%, no modification is used and the received duty cycle is used. If the duty cycle is high and the received activation signal repeats a message multiple times, the trainable transceiver unit 102 determines that dead time may be increased and RF power may be increased while maintaining the RF transmission power below maximum allowed levels (e.g., below a maximum average over time). The duty cycle may not need to be modified to include additional dead time (e.g., higher power) in an instance such as a case in which the default duty cycle is sufficient to meet power targets without increasing dead time in a sliding window for average power determination.

If the trainable transceiver unit 102 determines that the calculated duty cycle should be used, at step 414, trainable transceiver unit 102 stores the transmission parameters of the received activation signal (e.g., the duty cycle of the received activation signal) for use in transmitting activation signals formatted to control remote electronic system 112. In other words, trainable transceiver unit 102 uses the same duty cycle as that of the original transmitter and transmits activation signals formatted based on the stored activation signal characteristics and stored activation signal parameters at the maximum RF power of trainable transceiver unit 102.

If the trainable transceiver unit 102 determines that the calculated duty cycle of the received activation signal should be modified for future transmissions of activation signals, at step 316, trainable transceiver unit 102 calculates an amount of dead time to be added to transmitted activation signals in order to transmit with the increased RF power. The RF power may be increased to a maximum allowed value. For example, control circuit 208 may calculate the amount of dead time which may be added to the signal and the amount by which the power of the signal may be increased while maintaining the average power of the signal over a set time period (e.g., 100 mS) below a threshold value (e.g., set by the government). At step 414, trainable transceiver unit 102 stores the transmission parameters including amount of dead time (and in some embodiments the RF power) in memory 212 to use in future transmissions of activation signals. The trainable transceiver unit 102 then exists training mode and enter normal operation mode.

In some embodiments, the amount of dead time added is determined only to increase the RF power of transmissions relative to the received activation signal from the original transmitter rather than maximizing the RF power of transmitted activation signals. For example, trainable transceiver unit 102 may have a floor duty cycle limit (e.g., 25%) according to which dead time is determined. In other words, while it may be possible to increase the RF transmission power by reducing the duty cycle below the floor limit, the trainable transceiver does not increase the RF power when the duty cycle floor would be exceeded.

In normal operation mode, the trainable transceiver unit 102 uses the stored transmission parameters (e.g., the amount of dead time for the transmission and/or the calculated increased transmission power) and the stored activation signal characteristics to format an activation signal to control the remote electronics system 112. For example, the signal of the original transmitter is modified to have increased power, by inserting additional dead time and increasing the power of the transmission, and is transmitted in response to user input, received at the trainable transceiver unit 102, for controlling the remote electronics system 112 associated with the original transmitter. Advantageously, the trainable transceiver unit 102 is able to control the remote electronic system 112 associated with the original transmitter and generates an activation signal with more transmission power (and therefore more range) than the original transmitter.

Referring to FIG. 4, an exemplary dead time inserting scheme and an original RF transmission without dead time are shown for comparison. Block 402 shows an original data format of an activation signal without dead time (e.g., an activation signal from an original transmitter). The signals are generated and transmitted under government regulations. The average RF power is calculated through a 100 mS sliding window. The generated RF activation signal 406 (i.e. 25 mS GDO data) is repeated continuously through the whole transmission period 100 mS. With this scheme, the transmission duty cycle is 50% or +6 dB above continuous wave (CW) limits, i.e. a transmitting peak RF power reaches twice to the average RF power over the 100 mS sliding window.

Still referring to FIG. 4, block 404 shows inserting a 50 mS dead time 408 (i.e. no RF emission) within the transmitting messages. The generated RF signal 410 (i.e. 25 mS GDO data) is repeated twice and followed by a 50 mS dead time. With this dead time scheme, the transmission duty cycle is 25% or +12 dB, i.e. a transmitting peak RF power reaches four times to the average RF power over the 100 mS sliding window. Therefore, adding a 50 mS dead time 408 into a 100 mS RF message 410 doubles the peak RF transmitting power, which ultimately increases the transmission range. Advantageously, the dead time allows for increased power and transmission range while maintaining the average radio frequency power for a fixed time window below a threshold value that would be exceeded without the use of the dead time.

In some embodiments, the trainable transceiver receives a signal from an original transmitter consistent with the signal illustrated in block 402. The trainable transceiver calculates that the power of the RF signal may be increased if dead time is inserted into the signal (e.g., the duty cycle is reduced). The trainable transceiver formats activation signals for controlling a device associated with the original transmitter based on the calculated increased dead time increased RF power. For example, the modified transmission used by the trainable transceiver to control the device is consistent with the signal illustrated in block 404. The signals illustrated in blocks 402 and 404 are illustrative only. The trainable transceiver may receive signals with other characteristics or parameters and/or modify the signals resulting in signals having other characteristics or parameters than the illustrated signals.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A trainable transceiver for controlling a remote device, comprising:

a transceiver circuit configured to receive a first activation signal from an original transmitter and configured to transmit a second activation signal;

a user input device; and a control circuit coupled to the transceiver circuit and the user input device, wherein the control circuit is configured to format and transmit the second activation signal, based on the first activation signal, in response to a user input received at the user input device; and wherein the control circuit is configured to reduce a duty cycle of the second activation signal relative to the first activation signal and increase a radio frequency power of the second activation signal relative to the first activation signal, while maintaining, for the second activation signal, an average radio frequency power over a predetermined amount of time below a predetermined limit.

2. The trainable transceiver of claim 1, wherein the control circuit is further configured to:

calculate a duty cycle of the first activation signal; and determine if the duty cycle of the first activation signal is sufficiently high to permit increased dead time and increased radio frequency power.

3. The trainable transceiver of claim 1, wherein the control circuit is configured to insert dead time between messages of the second activation signal.

4. The trainable transceiver of claim 1, wherein the control circuit is configured to insert a dead time before messages of the second activation signal.

5. The trainable transceiver of claim 1, wherein the control circuit is configured to insert the same amount of dead time between messages of the second activation signal.

6. The trainable transceiver of claim 1, wherein the control circuit is configured to insert different amounts of dead time between messages of the second activation signal.

7. The trainable transceiver of claim 1, wherein the control circuit is configured to reduce a duty cycle, by reducing a percentage of modulation, of the second activation signal relative to the first activation signal and increase a radio frequency power of the second activation signal relative to the first activation signal, while maintaining, for the second activation signal, an average radio frequency power over a predetermined amount of time below a predetermined limit.

8. The trainable transceiver of claim 1, wherein the control circuit is configured to determine that the first activation signal includes two instances of a repeated message within a sliding window, and format the second activation signal by replacing one instance of the repeated message with dead time and increasing the radio frequency power used to transmit the other instance of the repeated message in the second activation signal.

9. The trainable transceiver of claim 1, wherein the control circuit is configured to determine the lowest duty cycle necessary to achieve a threshold radio frequency power.

10. The trainable transceiver of claim 1, wherein the control circuit is configured to process the first activation signal to identify a characteristic of a remote electronic system associated with the first activation signal, perform a lookup based on the characteristic to retrieve at least one of a dead time or a radio frequency power, and format the second activation signal based on the retrieved at least one of the dead time or radio frequency power.

11. A method for training a trainable transceiver, comprising:

receiving, at a transceiver circuit of the trainable transceiver, a first activation signal from an original transmitter; and formatting, at a control circuit of the trainable transceiver, a second activation signal based on the first activation signal, the second activation signal having a reduced duty cycle relative to the first activation signal, an increased radio frequency power relative to the first activation signal, and an average radio frequency power maintained over a predetermined amount of time below a predetermined limit.

12. The method of claim 11, further comprising entering a training mode for receiving the first activation signal based on receiving a user input at a user input device of the trainable transceiver.

13. The method of claim 11, further comprising processing the first activation signal to identify at least one characteristic of the first activation signal, wherein formatting the second activation signal includes formatting the second activation signal based on the at least one characteristic.

14. A method of training a trainable transceiver, comprising:

calculating a duty cycle of a first activation signal received by the trainable transceiver from an original transmitter;

determining that the duty cycle of the first activation signal is sufficient to meet a target radio frequency power of a second activation signal;

formatting the second activation signal using the duty cycle of the first activation signal in response to determining that the duty cycle of the first activation signal is sufficient; and decreasing a duty cycle of the second activation signal relative to the first activation signal in response to determining that the duty cycle of the first activation signal is not sufficient.

15. The method of claim 14, wherein calculating the duty cycle of the first activation signal includes calculating a dead time of the first activation signal.

16. The method of claim 11, further comprising storing parameters used to format the second activation signal in a memory of the trainable transceiver.

17. The method of claim 11, wherein formatting the second activation signal includes adding dead time relative to the first activation signal and increasing a radio frequency power of the second activation signal relative to the first activation signal.

18. The method of claim 17, wherein formatting the second activation signal includes adding dead time to maximize the radio frequency power of the second activation signal.

19. The method of claim 17, wherein formatting the second activation signal includes adding dead time based on a floor limit of a duty cycle of the second activation signal.

20. The method of claim 11, wherein formatting the second activation signal includes processing the first activation signal to identify a characteristic of a remote electronic system associated with the first activation signal, performing a lookup based on the characteristic to retrieve at least one of a dead time or a radio frequency power, and formatting the second activation signal based on the retrieved at least one of the dead time or radio frequency power.

* * * * *